US005708628A

United States Patent [19]

Chen

[11] Patent Number: 5,708,628

[45] Date of Patent: Jan. 13, 1998

[54] UNIVERSAL TIME EQUIPMENT

[76] Inventor: Eddie Zon Tsu Chen, 17411 Seco Ct., Rowland Heights, Calif. 91748

[21] Appl. No.: 702,975

[22] Filed: Aug. 26, 1996

[51] Int. Cl.[6] ..... G04B 19/22

[52] U.S. Cl. ..... 368/21

[58] Field of Search ..... 368/21–27

[56] References Cited

U.S. PATENT DOCUMENTS

| | | | |
|---|---|---|---|
| 893,772 | 7/1908 | Aufiero | 368/21 |
| 2,078,345 | 4/1937 | Robertson | 368/21 |
| 3,115,002 | 12/1963 | Beresford | 368/21 |
| 4,183,203 | 1/1980 | Maezawa et al. | 368/21 |

*Primary Examiner*—Bernard Roskoski

*Attorney, Agent, or Firm*—David & Raymond; Raymond Y. C. Chan

[57] ABSTRACT

An universal time equipment enables the user to ascertain the times of 24 time zones around the world easily, precisely and simultaneously, including a stationary dial mounted above a 24-hour movement which projects at least an hour shaft and a minute shaft therefrom, a transparent time zone disc being secured to rotate above the dial, and a minute hand mounted to said minute shaft to rotate above the time zone disc. The dial provides an outer hour indicating ring portion, an inner minute indicating ring portion adjacent to the outer hour indicating ring portion, and a central time condition indicating portion which is divided into four time conditions for facilitating the user to ascertain the time condition of the time observed. The time zone disc has 24 time zone indicators provided in the outer periphery thereof, a transparent central portion for revealing the dial underneath, and a sun mark positioned adjacent to the hour indicating ring portion and aligned with one of the time zone.

18 Claims, 11 Drawing Sheets

UNIVERSAL TIME EQUIPMENT

BACKGROUND OF THE PRESENT INVENTION

The present invention relates to a timepiece such as a clock or a watch, and more particularly to an universal time equipment which can simultaneously provide precise and easy-read indication of the times and their time conditions in a day of the 24 time zones around the world respectively.

In the coming 21th century, another industry revolution of computer science begins to internationalize the human life. The world becomes smaller that people can communicate with other areas or countries in the Earth instantly, easily and conveniently through telephone, facsimile, and interact. Products and people like merchants and professional consultants are traveling place to place every moment. Time management becomes a major topic nowadays. Furthermore, time also becomes internationalized since people have to contact another countries for business or information any time. Consequently, more and more people need to ascertain the precise times of various countries in different time zones simultaneously.

The first timepiece was invented three hundred years ago, the standard design and corresponding construction of the timepieces basically remain in the numeral display stage. Besides some alternative design to the appearance or interior driving mechanism of timepieces, the conventional timepieces simply provided an hour hand, a minute hand and a second hand mounted for rotating above a dial to indicate the current time only by numerals of 1–12 inscribed on the dial, for example 7:30 o'clock, so that it is impossible ascertain whether it is day or night or what part of day it is in any particular country without reference to the outdoor circumference.

Since the dial of the conventional time piece as described above has only numerals 1–12 inscribed on the periphery thereof, the current local time indicated by the hour, minute and second hands is a numeral data only. One can not ascertain whether the indicated time is a day time or a night time simply by such numeral data provided by the 12-hour dial of the conventional timepiece. For example, if the indicated time is seven-thirty o'clock, one cannot determined that it is 7:30 a.m. or 7:30 p.m. without a further observation of the outdoor circumstances. Therefore, for people in an indoor area, such as a surgery doctor in a surgical room, a tourist in a casino, an engineer in subway, a worker in an air conditioning factory, or a traveler in an airplane, the conventional timepiece is unable to act as a true time teller. It is impossible to determine the day time or night time according to such common timepiece.

A specified 24-hour timepiece can partially solve the above problem, which comprises a dial having numerals from 1 to 24 inscribed on the periphery thereof. The movement of the 24-hour timepiece is designed to drive the hour hand rotating one revolution per 24 hours. People in an indoor surrounding can roughly determine the indicated time of 6 to 18 o'clock as day time and 19 to 5 o'clock as night time. This kind of 24-hour timepiece is particularly useful in military time indicating purpose because it can tell the exact time within 24 hours. However, soldiers have to receive special training to accustom to the sense of time representing by the numerals of 13 to 24 o'clock.

The "sense of time" is a picture in mind which is respective to accustomed human activities at certain designated time. For example, one should wake up at 7:00 a.m. (in early morning), the outdoor weather should be hotter at about 3:00 p.m. (in the afternoon), one will feel hungry for dinner at 8:00 p.m. (in the evening), and one will feel tired and sleepy at 10:00 p.m. (at night). However, what do the 7:00 a.m., 3:00 p.m., 8:00 p.m., and 10:00 p.m. represent? They represent the "time condition" within a day.

The Earth self-rotating one revolution is one day and we divide one day into 24 hours (but not 12 hours). Time condition of a place actually is the variation of sunlight within a day since the time is a calculation of how does the Earth self-rotating and rotating around the sun. The 7:00 a.m. represents a rooming time condition that the sun just rises and provides a mild sunlight. The 3:00 p.m. represents an afternoon time condition that the sun has a shorter distance from the Earth and provides a stronger sunlight. The 8:00 p.m. represents an evening time condition that the sun sets already and does not provide sunlight. People accustom to have various activities at difference time conditions and thus construct the "sense of time".

Since the first timepiece invented, it was a 12-hour timepiece. People were used to read the time through numerals 1 to 12 for more than three hundred years. However, such 24-hour timepiece really bothers most people when one read the time indicated by a numeral larger than 12, such as 15, 17, 19, or 22 o'clock, because, generally, people cannot picture the "sense of time" respective to a numeral larger than 12 immediately. It is the reason that why the 24-hour timepiece is not popular up to now. Nowadays, almost all the timepieces sale in market are still the 12-hour timepieces. Besides, both the conventional 12-hour timepiece and 24-hour timepiece cannot indicate the "time conditions", such as the four time conditions of morning period, afternoon period, evening period, from and night period, within one day.

Moreover, half a century ago, most people in the Earth resided in one local place for their whole life. People rarely had the chance to travel aboard or to contact with anyone overseas. Therefore, those conventional timepieces which were merely designed for time observation in one place could fulfill the local need in the past. However, most of the modem people experience a common troublesome of time observation from the conventional timepieces that they have to compute the foreign time by adding or deducting a hour difference with the local time observed from the conventional timepieces. In fact, the most difficult matter is that it is very difficult for most people to learn by heart all the time difference between every two time zones, especially when people need to travel from place to place often.

As shown in FIG. 1, a conventional 24-hour timepiece 1 with an exterior time zone ring 11 mounted on an outer rim 12 of the timepiece 1 in the usual manner is illustrated. When the user needs to observe the time of another time zone city other than the local time pointing by an hour hand 13, the user has to turn the exterior time zone ring 11 until the local city name corresponding to an hour hand point 131 so that the user can read the current time of another city from a dial 14 coincident with the city name on the time zone ring 11. Since the user has to rotate the time zone ring 11 every time when the user needs to observe the current time of another city, it is very troublesome and violates the principle of user's friendly.

A timepiece with simultaneous time display for at least two time zones is disclosed in U.S. Pat. No. 5,323,363. It is convenience for travelers who always travel between two cities only. If the user travels to a third city, the user has to reset the timepiece again and the setting procedure is very troublesome. Firstly, adjust the time indicated by the hour and minute hands corresponding to a time zone city in an usual manner. Secondly, operate the time zone disc to display the city name corresponding to the local time zone and, during this operation, the 24-hour disc is also driven in rotation synchronically with the time zone disc. In this stage, the time indicated by the numeral of the 24-hour disc, which is opposite the mark after the rotation of the time zone disc, generally does not correspond to the time indicated by the hour hand. Therefore, the two indications of time should be made to correspond, which is achieved by a third step of operating solely the 24-hour disc in such manner that the numeral coming opposite the mark corresponds to the time indicated by the hour hand. Furthermore, one has to take into account whether the time indicated on the dial by the hour hand is a day time or a night time.

After detail analysis of the market existing timepieces, an essential common problem of those conventional timepieces is discovered. Basically, the conventional timepieces are designed to mainly indicate the current time of a local city where the user resides solely by numeral data only. Such time indicating concept violates the nature of time. That is why the conventional timepieces cannot fulfill the necessity of the internationalization of human life nowadays.

SUMMARY OF THE PRESENT INVENTION

The main object of the present invention is to provide an universal time equipment which not only can simultaneously provide clear indication of the current times of the 24 time zones around the world, but also can clearly indicate the "time condition" in a day for the observed current time of any time zone.

Another object of the present invention is to provide an universal time equipment which can indicate the time in each time zone without the present of the hour hand.

Another object of the present invention is to provide an universal time equipment capable of driving a time zone disc to complete one revolution every 24 hours (just like the self-rotation of the earth everyday) without incorporating with any additional driving mechanism. Therefore, the present invention minimizes its constructive parts and is easy to assemble in inexpensive cost.

Another object of the present invention is to provide an universal time equipment that enables the user to read the hour, minute and second of the time in each time zone (city) around the world easily, in which the time zone disc has an outer time zone ring which provides 24 hour pointers radically extended from 24 time zone indicators to an inner periphery of the time zone ring portion respectively for aligning with the 24 hour scales of the hour indicating ring portion respectively, and that the minute indicating ring portion is adjacent to the inner periphery of the hour indicating ring portion, so that the user can simply and effectively read the time of any particular time zone city as indicated in the time zone disc by simply and effectively observing the particular time zone city on the time zone disc and reading the hour scale adjacent the corresponding hour pointer and, at the same time, reading the exact minute and second of time off the minute and second hands that sweeps the adjacent minute indicating ring portion.

Another object of the present invention is to provide an universal time equipment capable of incorporating with at least a sun mark to particularly distinct the local time from the times of other time zones.

Accordingly, the present invention provides an universal time equipment which comprises a movement coupled and driven at least an hour shaft to rotate one revolution per 24 hours and a minute shaft to rotate one revolution per hour, a stationary dial mounted above the movement, a transparent rotatable time zone disc being affixed to the hour shaft by a securing means for being driven by the hour shaft to rotate above the dial to complete one revolution every 24 hours, and a minute hand secured to the minute shaft for rotating above the time zone disc to complete one revolution every one hour. On a front surface of the dial has an outer hour indicating ring portion, an inner minute indicating ring portion arranged radically adjacent an inner periphery of the outer hour indicating ring portion, and a central circular time condition indicating portion encircled by the inner minute indicating ring portion.

The time condition indicating portion is positioned on a central circular portion of the dial encircled by an inner periphery of the minute indicating ring portion. The time condition indicating portion has a central cross inscription having a vertical line extending from a top to a bottom of the time condition indicating portion and a horizontal line extending from a left to a right of the time condition indicating portion, so as to divide the time condition indicating portion into a top-left, a top-right, a bottom-right, and a bottom-left quarter sections for constituting four time conditions of day. A day indicator and a night indicator are provided on the upper and lower portions of the time condition indicating portion respectively. A antemeridian indicator and a postmeridian indicator are provided on the left and the right portions of the time condition indicating portion respectively. A morning indicator, an afternoon indicator, an evening indicator, and a midnight indicator are provided on the top-left, top-right, bottom-right, and bottom-left quarter section so as to designated the four time conditions respectively on the time zone indicating portion of the dial. In addition, the four quarter sections have different colors to further distinctly designate the four time conditions for easy observation, in which the bottom-right and bottom-left quarter sections have a darker color than the color of the top-left and top-right quarter sections for distinguishing the top-left and top-right quarter sections as the day time and the bottom-right and bottom-left as the night time.

The minute indicating ring portion encircles the time condition indicating portion and is evenly divided into 60 annular scales providing a visual indication of 60 minutes in one hour. The hour indicating ring portion peripherally encircling the minute indicating ring portion provides 24 hour scales inscribed thereon, which are two sequences of numerals ordered by increasing value from 1 to 12 and arranged circularly spaced apart angularly, wherein a first numeral "12" is provided in a top position, a second numeral "12" is provided in a bottom position, a first numeral "6" is provided in a left position, and a second numeral "6" is provided in a right position.

The time zone disc has a time zone ring portion provided on an outer periphery of the time zone disc to encircle a transparent central portion which has a diameter at least equal to the diameter of the hour indicating ring portion of the dial for revealing the hour indicating ring portion, the minute indicating ring portion and the time condition indicating portion. The time zone ring portion provides 24 time zone indicators arranged circularly spaced apart angularly to represent the 24 time zone cities. There are 24 hour pointers radically extended from the 24 time zone indicators to the inner periphery of the time zone ring portion respectively to align with the 24 hour scales of the hour indicating ring portion respectively. Moreover, since some particular time zones, such as time zone cities Alaska, Los Angeles, Denver, Chicago, New York, Azores, London, Pads Cairo, Moscow, and Sydney, utilize "Summer Time". Each hour pointer of the corresponding Summer Time utilizing time zone city further provides a projection line extending clockwise to the adjacent hour pointer, so as to provide an indication for the user to read the hour scale aligned with the projecting adjacent hour pointer during "Summer Time" of that time zone city. In order to clearly indicate the local time of the user, the time zone disc further provides a sun mark thereon in a predetermined position adjacent to the inner periphery of the hour indicating ring portion of the dial and radically aligned with the corresponding time zone indicator representing the local city of the user, so that the hour scales will be just positioned between the local time zone indicator and the sun mark. Therefore, the user can easily distinct his or her local time zone indicator and hour anytime.

In a preferred embodiment, the day indicator is a "day" mark inscribed on an upper part of the vertical line. The night indicator is a "night" mark inscribed on a lower part of the vertical line. The antemeridian is an "a.m." mark inscribed on a left part of the horizontal line. The postmeridian is a "p.m." mark inscribed on a right part of the horizontal line. The morning indicator is a "MORNING" mark inscribed on a predetermined position of the top-left section in an arc form extending from the left part of the horizontal line to the upper part of the vertical line. The afternoon indicator is an "AFTNOON" mark inscribed on a predetermined position of the top-right section in an arc form extending from the upper part of the vertical line to the right part of the horizontal line. The evening indicator is a "EVENING" mark inscribed on a predetermined position of the bottom-right section in an arc form extending from the right part of the horizontal line to a lower part of the vertical line. The midnight indicator is a "MIDNITE" mark inscribed on a predetermined position of the bottom-left section in an arc form extending from the lower part of the vertical line to the left part of the horizontal line.

BRIEF DESCRIPTION OF THE DRAWINGS

FIG. 9 is a partial section view of the alternative mode shown in FIG. 9A.

DETAILED DESCRIPTION OF THE PREFERRED EMBODIMENT

Figure 1:
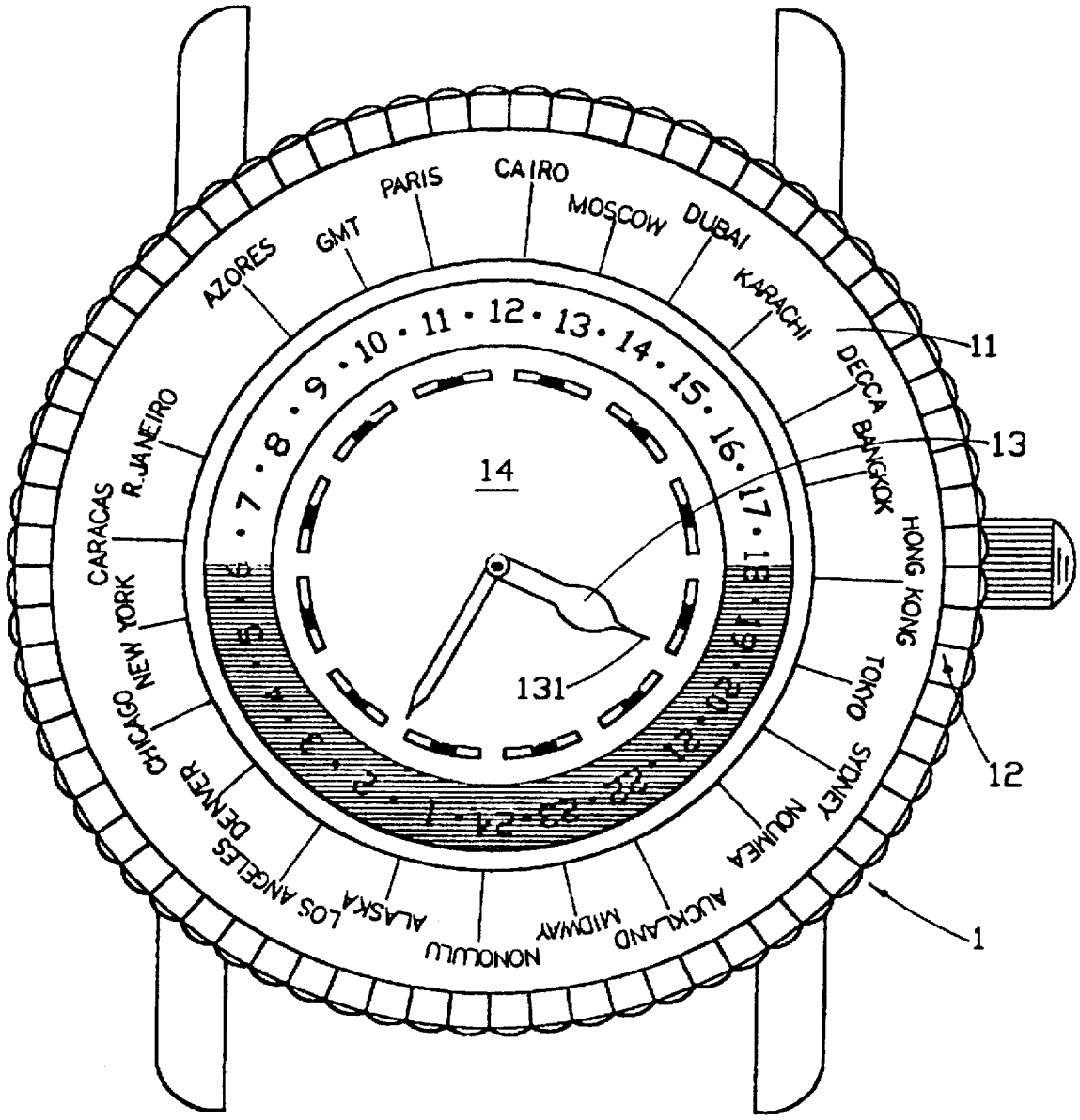
FIG 1 PRIOR ART
FIG. 1 is a front view of a conventional timepiece with time zone mechanism.
Figure 2:
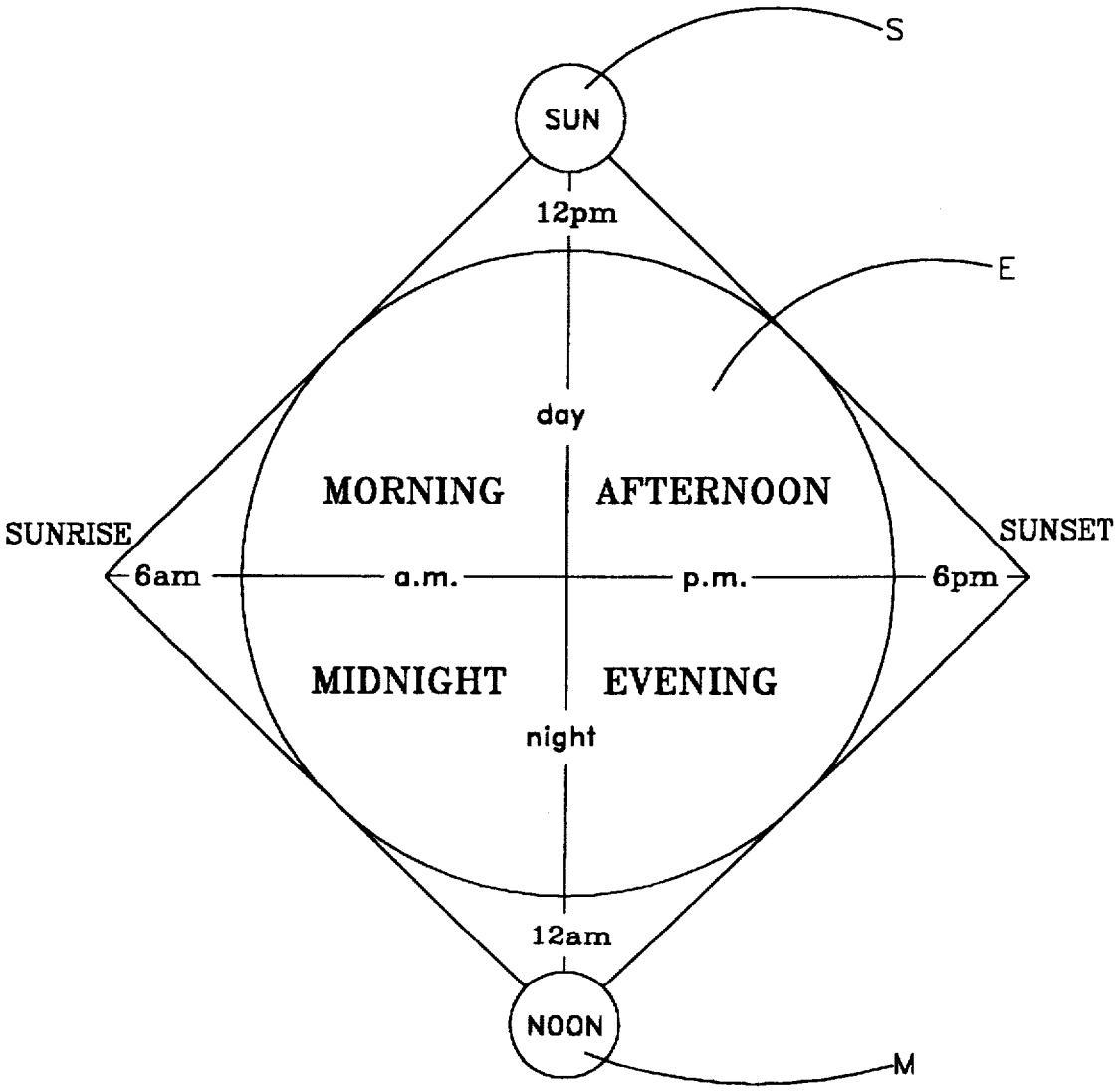
FIG. 2 is a schematic view showing the relationship the sun, the earth and the moon.

The feeling of time comes from the mutual relationship between the sun S, the earth E and the moon M, as shown in FIG. 2. The earth E self-rotating one revolution is one day and the earth E rotating around the sun S for one revolution is one year. Therefore, we can observe the sunrise and sunset in the day time and we can also observe the moonrise and moonset at night. As shown in FIG. 2, any place located at an upper half of the globe facing the sunlight projected from the sun S is in the "day" time. In other words, any place located at a lower half of the globe is in the "night" time and no sunlight is projected there. Thus, any place on the earth E travels 12 hours of day time and 12 hours of night time in one 24-hours day for each self-rotation of the earth E.

For a resident R in a local city on the earth E, he or she will only observe that the sun S rises from the east and sets at the West. In other words, a day begins from "midnight" (12:00 a.m.). Everyday, the resident R experiences the sunrise at about 6:00 a.m. after a 6 hours "midnight" period of the day. The resident R further experiences the midday (12:00 p.m. at noon) after a 6 hours "rooming" period of the day, in which from midnight (12:00 a.m.) to noon (12:00 p.m.) is ante meridian time. After 12:00 p.m., the resident R experiences an "afternoon" period for another 6 hours until sunset at about 6:00 p.m.. The resident R then experiences an "evening" period of the day for 6 hours before the end of one day at midnight, wherein from noon to midnight is post meridian time. Hence, when the left half side of the globe is in ante meridian time, the right half side of the globe should be in post meridian time. The local city has a farest distance from the sun S in "midnight" and a shortest distance from the sun S at noon.

Accordingly, one day has 24 hours and generally comprises four "time conditions", i.e. the midnight period, morning period, afternoon period, and evening period. Generally, we divide a day into two equal half sections according to the observation of sunlight, wherein from 6:00 a.m. to 6:00 p.m. is "day" time section and from 6:00 p.m. to 6:00 a.m. is "night" time section. The time modes mentioned above are the natural conditions of time constituting one day. In other words, the feeling of time is established through the variation of sunlight within one day. Therefore, practically, a timepiece should provide the indication of the natural time conditions in one day as the basic time computing standard. Moreover, although the earth E is self-rotating respective to the sun S, people on the earth E cannot feel such rotation. Therefore, when people observe the current time from timepieces on the earth, they normally think that they are in static condition and the sun S is rotating around the earth E. Accordingly, the hour hand of a timepiece would actually represent the movement of the sun S in one day.

Figure 3:
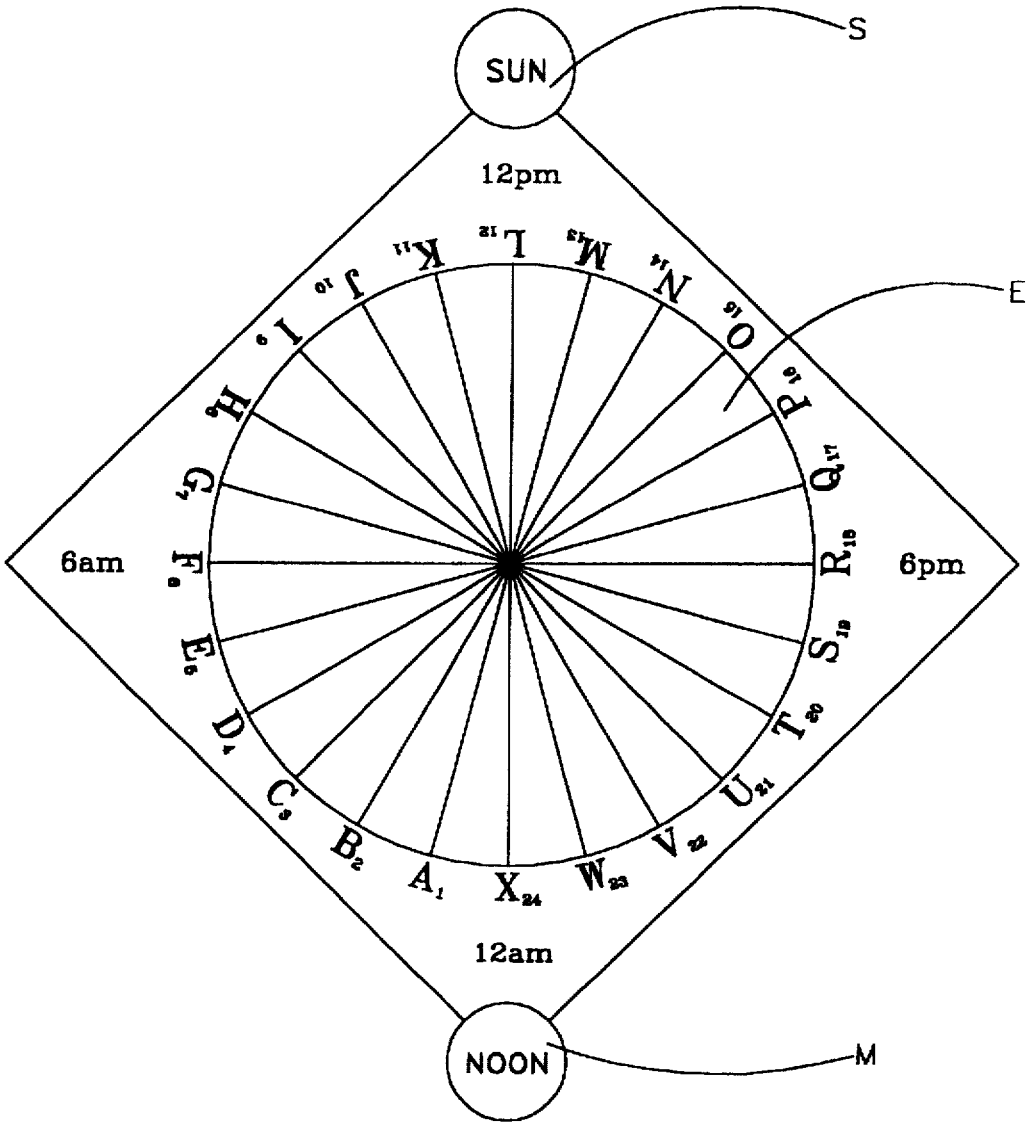
FIG. 3 is a schematic view illustrating the distribution of the 24 time zone when the earth positioned between the sun and the moon is viewed from the north pole thereof.

As shown in FIG. 3, the earth E is viewed from the north pole thereof. During the serf-rotation of the earth E respective to the sun S in a day, the sunlight will be projected onto the cities located at the different longitudes A1 to X24 (as shown in FIG. 3) of the earth E one by one orderly. In fact, when some cities located at some longitudes such as A1 to E5 still experience the midnight period, some other cities located at some longitudes such as F6 to R18 are experiencing different intensity of sunlight in the morning period or afternoon period. Accordingly, if the earth E is equally divided into 24 sections, there are totally 24 time zones that each time zone has a time difference of one hour with the adjacent time zone.

| | |
|---|---|
| A1: 1 a.m.: Midway | M13: 1 p.m.: Paris |
| B2: 2 a.m.: Honolulu | N14: 2 p.m.: Cairo |
| C3: 3 a.m.: Alaska | O15: 3 p.m.: Moscow |
| D4: 4 a.m.: Los Angeles | P16: 4 p.m.: Dubai |
| E5: 5 a.m.: Denver | Q17: 5 p.m.: Karachi |
| F6: 6 a.m.: Chicago | R18: 6 p.m.: Decca |
| G7: 7 a.m.: New York | S19: 7 p.m.: Bangkok |
| H8: 8 a.m.: Caracas | T20: 8 p.m.: Hong Kong |
| I9: 9 a.m.: R. Janeiro | U21: 9 p.m.: Tokyo |
| J10: 10 a.m.: −2 Hours | V22: 10 p.m.: Sydney |
| K11: 11 a.m.: Azores | W23: 11 p.m.: Noumea |
| L12: 12 p.m.: London | X24: 12 a.m.: Auckland |

As illustrated above, the time difference between any two particular time zones are a constant value. For example, the time difference between Los Angeles located at time zone D4 and New York located at time zone G7 is 3 hours, i.e. when the time of New York is at 7 a.m., the time of Los Angeles is 3 hours earlier at 4 a.m.. The following chart is a time chart for 24 representing cities in the 24 time zones shown in FIG. 3 for illustrating the time difference between those time zones.

The natural fact is that one day has 24 hours and the earth has 24 time zones, where every time zone experiences 24 hours everyday and has its own local current time. This is the natural time mode of one day on earth. Therefore, if we view the earth E from north pole, we can observe each of the 24 time zones is self-rotating to complete one revolution in one day simultaneously.

Accordingly, those conventional timepieces violate the natural time mode as described above. They simply provide numeral indication of time and tell nothing about the "time condition". Every intention of providing the times of more than one time zone for the conventional timepiece will consequently complicate the timing mechanism and highly increase the cost. The above description is the basic conception of the present invention which provides a solution to those shortcomings and problems of the conventional timepieces.

Figure 4:
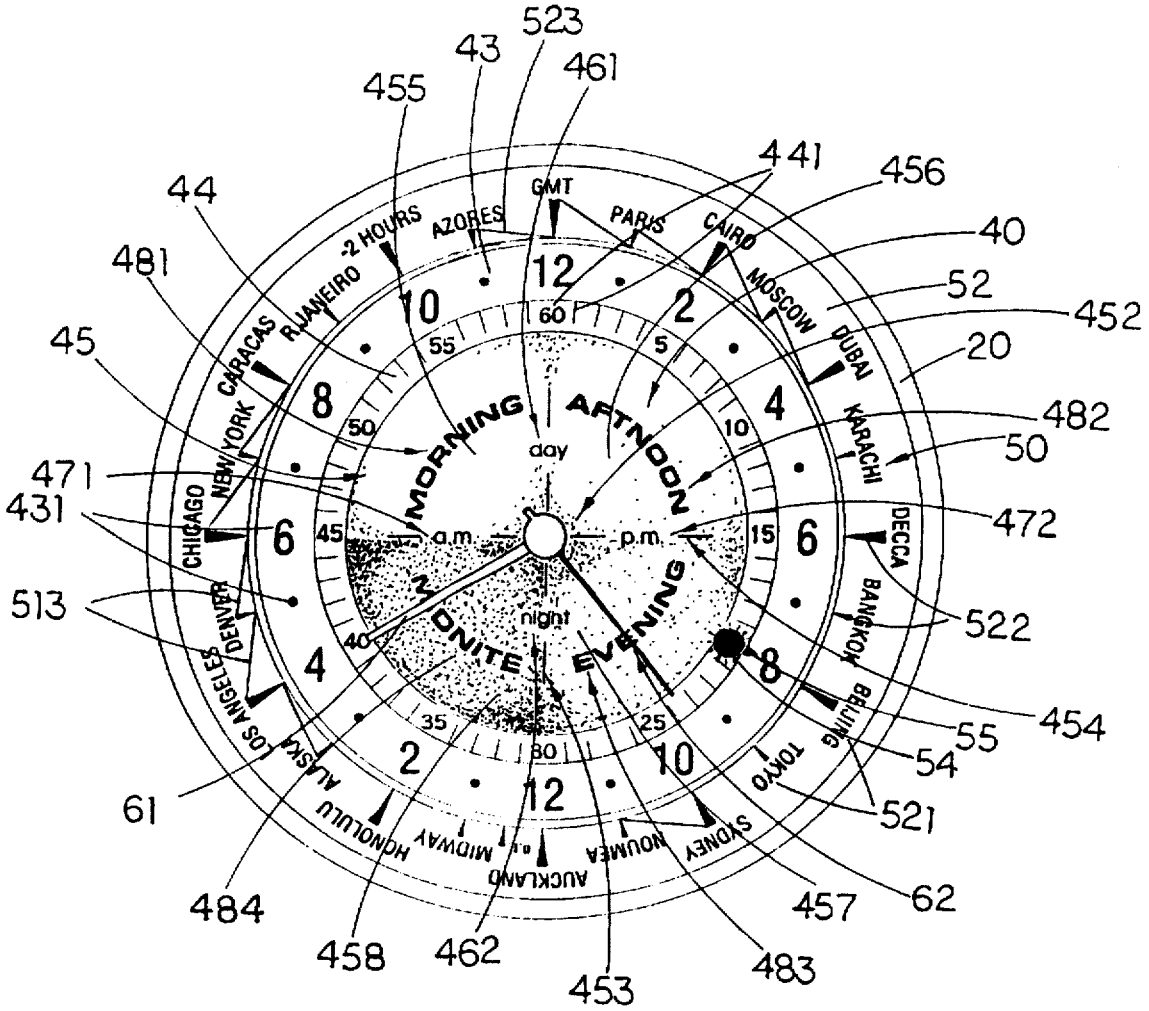
FIG. 4 is a front view of an universal time equipment according to a preferred embodiment of the present invention.
Figure 5:
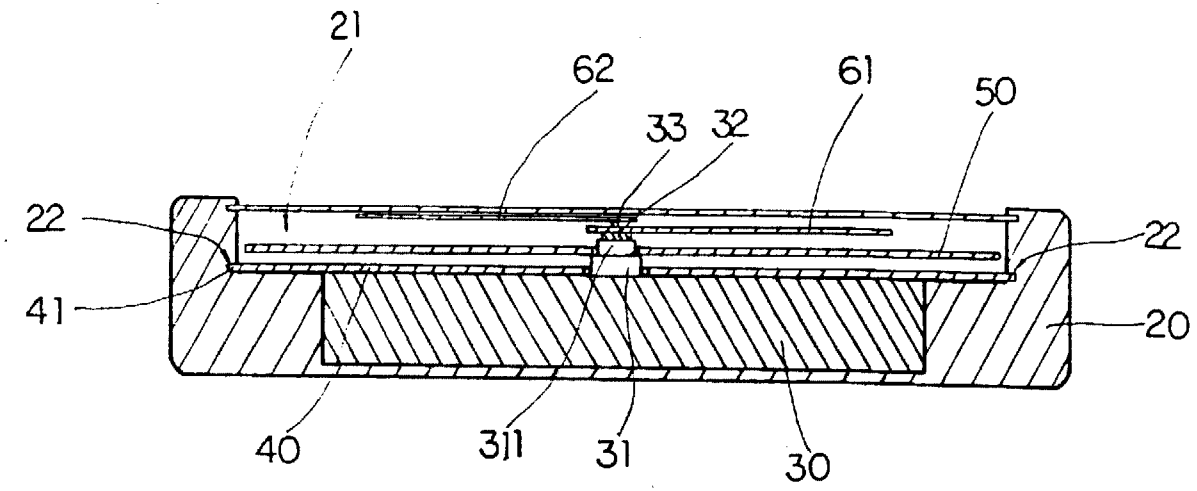
FIG. 5 is a sectional end view of FIG. 4.
Figure 6:
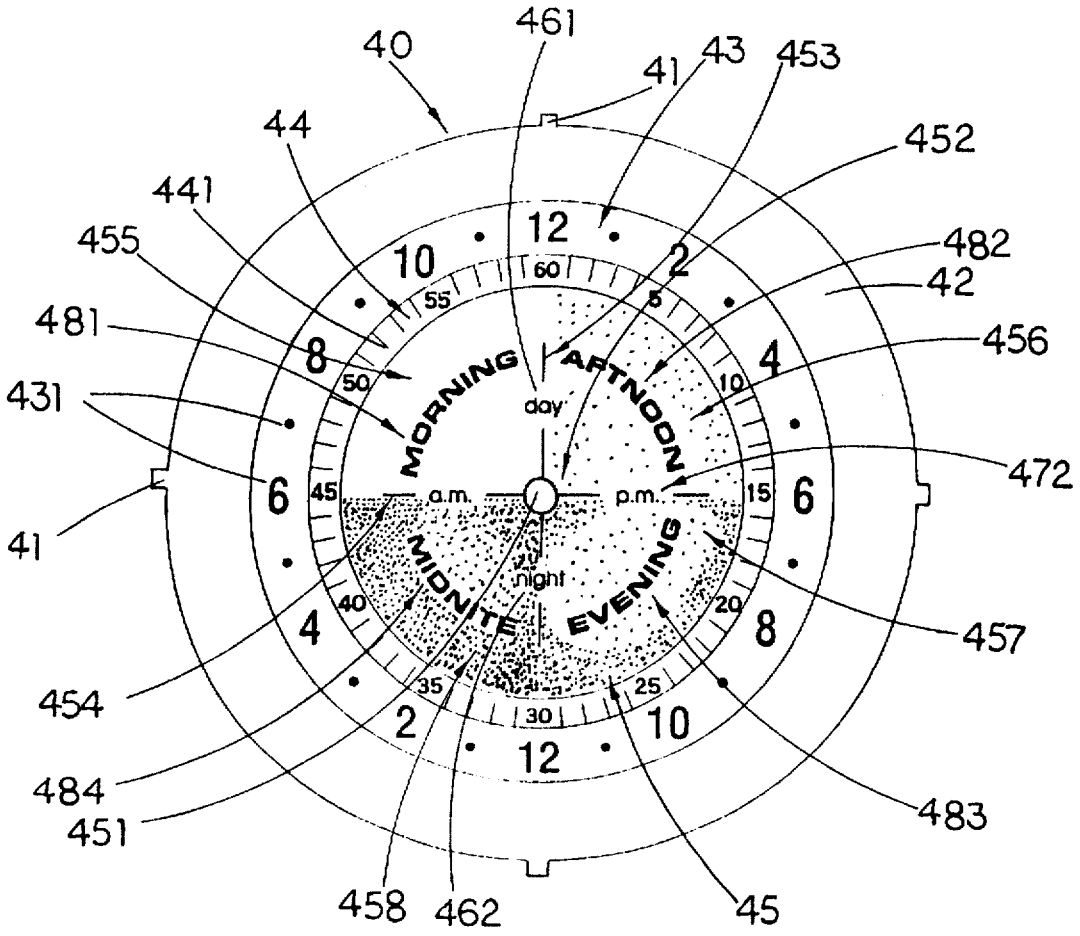
FIG. 6 is a front view of the dial of the universal time equipment according to the above preferred embodiment of the present invention.
Figure 7:
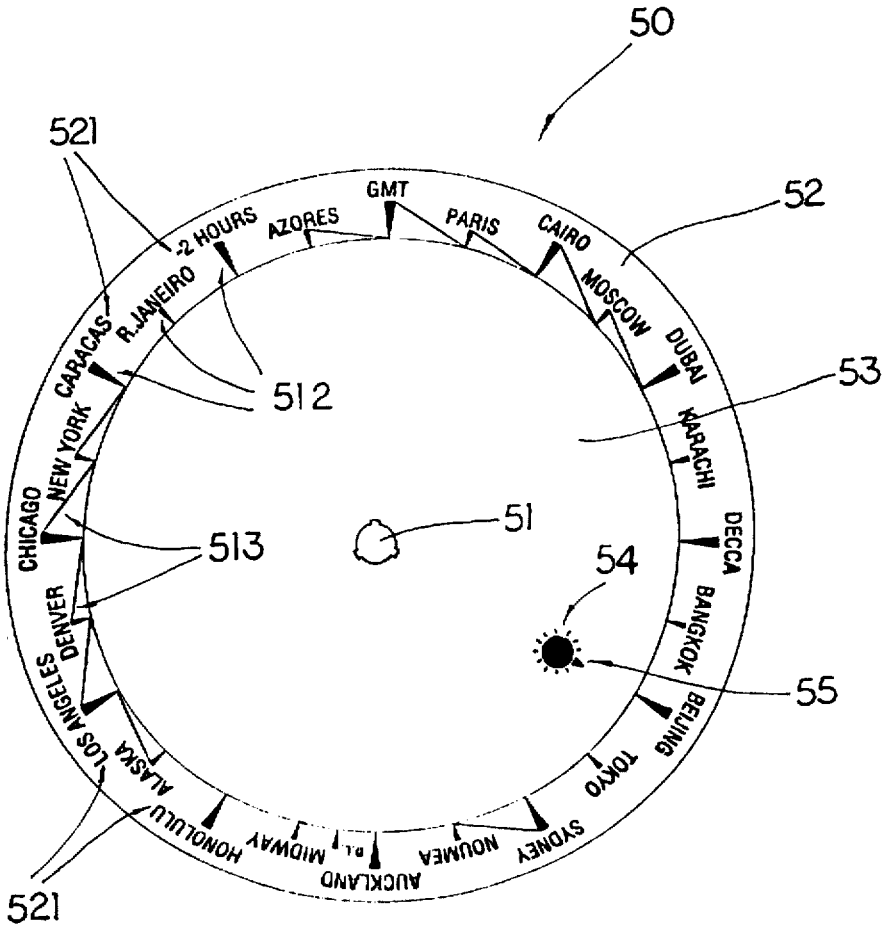
FIG. 7 is a front view of the time zone disc of the universal time equipment according to the above preferred embodiment of the present invention.

Referring to FIGS. 4 to 8, an universal time equipment according to a preferred embodiment of the present invention is illustrated. The universal time equipment comprises a case 20 for installing a 24-hour movement 30 therein in an usual manner. The 24-hour movement 30, as shown in FIG. 5, couples and drives at least an hour shaft 31 to rotate one revolution per 24 hours, a minute shaft 32 to rotate one revolution per hour, and a second shaft 33 to rotate one revolution per minute. The case further has a chamber 21 for receiving a stationary dial 50 (as shown in FIG. 6), a transparent rotatable time zone disc 50 (as shown in FIG. 7), a minute hand 61, and a second hand 62.

As shown in FIGS. 5 and 6, the dial 40 has a plurality of peripheral protruding lips 41 for inserting into a plurality of corresponding grooves 22 provided on the bottom periphery of the chamber 21 so as to mount the dial 40 above the movement 30 (as illustrated in FIG. 5). On a front surface of the dial 40, as shown in FIGS. 4 and 6, has an outermost blank circular portion 42, an outer hour indicating ring portion 43, an inner minute indicating ring portion 44 arranged radically adjacent an inner periphery of the outer hour indicating ring portion 43, and a central circular time condition indicating portion 45 encircled by the inner minute indicating ring portion 44.

The time condition indicating portion 45 is positioned on a central circular portion of the dial 40. The time condition indicating portion 45 has a central hole 451, permitting the hour, minute and second shafts 31, 32, 33 to pass through, and a central cross inscription 452. The central cross inscription 452 has a vertical line 453 extending from a top to a bottom of the time condition indicating portion 45 and a horizontal line 454 extending from a left to a right of the time condition indicating portion 45, so as to divide the time condition indicating portion 45 into atop-left, atop-right, a bottom-right, and a bottom-left quarter sections 455, 456, 457, 458 for constituting four time conditions of day. A day indicator 461 and a night indicator 462 are provided on the upper and lower portions of the time condition indicating portion 45 respectively. A antemeridian indicator 471 and a postmeridian indicator 472 are provided on the left and the right portions of the time condition indicating portion 45 respectively. A morning indicator 481, an afternoon indicator 482, an evening indicator 483, and a midnight indicator 484 are provided on the top-left, top-right, bottom-right, and bottom-left quarter section 455, 456, 457, 458, so as to designated the four time conditions respectively on the time zone indicating portion 45 of the dial 40. In addition, the four quarter sections 455, 456, 457, 458 have different colors to further distinctly designate the four time conditions for easy observation, in which the bottom-right and bottom-left quarter sections 457, 458 have a darker color than the color of the top-left and top-right quarter sections 455, 456 for distinguishing the top-left and top-right quarter sections 455, 456 as the day time and the bottom-right and bottom-left quarter sections as the night time 457, 458.

In accordance with the present preferred embodiment, the day indicator 461 is a "day" mark inscribed on an upper part of the vertical line 453. The night indicator 462 is a "night" mark inscribed on a lower part of the vertical line 453. The antemeridian 471 is an "a.m." mark inscribed on a left part of the horizontal line 454. The postmeridian 472 is a "p.m." mark inscribed on a right part of the horizontal line 454. The morning indicator 481 is a "MORNING" mark inscribed on a predetermined position of the top-left quarter section 455 in an arc form extending from the left part of the horizontal line 454 to the upper part of the vertical line 453. The afternoon indicator 482 is an "AFTNOON" mark inscribed on a predetermined position of the top-right quarter section 456 in an arc form extending from the upper part of the vertical line 453 to the right part of the horizontal line 454. The evening indicator 462 is a "EVENING" mark inscribed on a predetermined position of the bottom-right quarter section 457 in an arc form extending from the right part of the horizontal line 454 to the lower part of the vertical line 453. The midnight indicator 484 is a "MIDNITE" mark inscribed on a predetermined position of the bottom-left quarter section 458 in an arc form extending from the lower part of the vertical line 453 to the left part of the horizontal line 454.

Accordingly, as shown in FIGS. 2 and 6, the central time condition indicating portion 45 of the dial 40 is designed to indicate the various natural "time conditions" of day, night, a.m., p.m., morning, afternoon, evening, and midnight in a day as if it is a stationary globe. The minute indicating ring portion 44 which encircles the time condition indicating portion 45 is evenly divided into 60 annular scales 441 providing a visual indication of 60 minutes in one hour. The hour indicating ring portion 43 peripherally encircling the minute indicating ring portion 44 provides 24 hour scales 431 inscribed thereon, which are two sequences of numerals ordered by increasing value from 1 to 12 and arranged circularly spaced apart angularly, wherein a first numeral "12" is provided in a top position, a second numeral "12" is provided in a bottom position, a first numeral "6" is provided in a left position, and a second numeral "6" is provided in a right position. Moreover, according to the present embodiment, only the even numerals (including 2, 4, 6, 8, 10, 12) are provided and the odd numerals such as 1, 3, 5, 7, 9, 11 are replaced by a plurality of dots.

The time zone disc 50, as shown in FIG. 7, has a center hole 51, a time zone ring portion 52 provided on an outer periphery of the time zone disc 50 to encircle a transparent central portion 53 which has a diameter equal to or slightly larger than the diameter of the hour indicating ring portion 43 of the dial 40 for revealing the hour indicating ring portion 43, the minute indicating ring portion 44 and the time condition indicating portion 45. The time zone ring portion 52 provides 24 time zone indicators 521 arranged circularly spaced apart angularly to represent the 24 time zone dries. There are 24 hour pointers 522 radically extended from the 24 time zone indicators 521 to the inner periphery of the time zone ring portion 52 respectively to align with the 24 hour scales 431 of the hour indicating ring portion 43 respectively.

The 24 time zone indicators 521, according to the present embodiment, are 24 inscriptions of the 24 time zone city names as illustrated in the above time chart. Moreover, since some particular time zones, such as time zone cities Alaska, Los Angeles, Denver, Chicago, New York, Azores, London, Pads Cairo, Moscow, and Sydney, utilize "Summer Time". The time zone ring portion of 52 of the time zone disc 50 provides a plurality of projection lines 523. Each of the projection lines 523 is positioned between two hour pointers 522, wherein each projection line 523 is extended closewise from an outer end of the hour pointer 522 of the corresponding time zone indicator 521 which utilizes summer time to an inner end of another hour pointer 522 adjacent thereto, so as to provide an easy-read indication for the user to read the respective hour scale 441 aligned with the projecting adjacent hour pointer 522 during "Summer Time" of that time zone city.

The transparent rotatable time zone disc 50, as shown in FIGS. 4 and 5, is affixed to the hour shaft 31 for being driven by the hour shaft 31 to rotate above the dial 40 to complete one revolution every 24 hours. The minute hand 61 is secured to the minute shaft 32 for rotating above the time zone disc 50 to complete one revolution every one hour. The second hand 62 is secured to the second shaft 33 for rotating above the time zone disc 50 to complete one revolution every one minute. A top portion of the hour shaft 31 reduces the outer diameter thereof to form an engaging head 311. The engaging head 311 has a height at least equal to the thickness of the time zone disc 50 and a diameter equal to or slightly smaller than the diameter of the center hole of the time zone disc 50, so that the time zone disc 50 can be firmly secured to the hour shaft 31 by inserting the engaging head 311 of the hour shaft 31 through the center hole 51 of the time zone disc 50.

In order to clearly indicate the local time of the user, the time zone disc further prints or attaches a sun mark 54 thereon in a predetermined position adjacent to the inner periphery of the hour indicating ring portion 43 of the dial 40 and radically aligned with the corresponding time zone indicator 521 representing the local city of the user, so that the hour scales 431 will be just positioned between the particular local time zone indicator 521 and the sun mark 54. Furthermore, the sun mark 54 further provides a sun mark pointer 55 radically extending therefrom and pointing to the local time zone indicator 521. Therefore, the user can easily distinct his or her local time zone indicator 521 and hour anytime.

Figure 8:
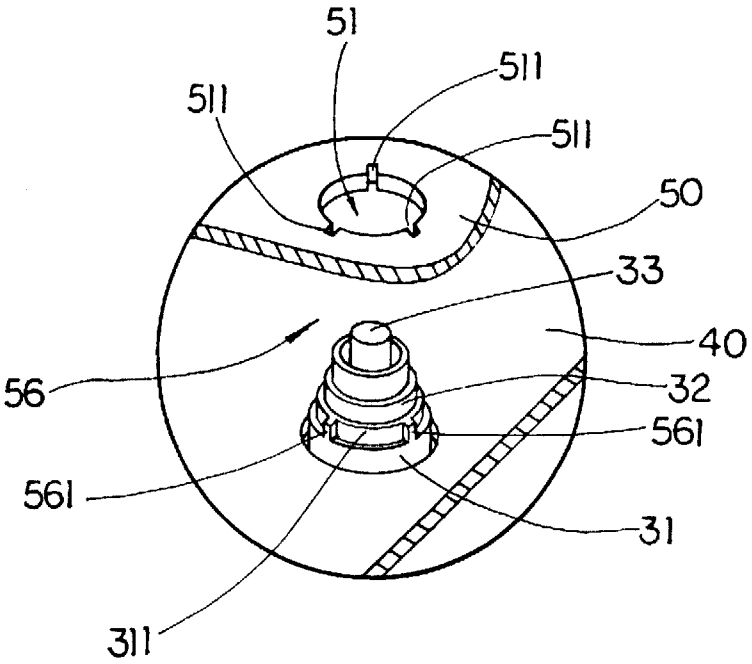
FIG. 8 is a partial exploded view of the universal time equipment according to the above preferred embodiment of the present invention.

For ensuring the time zone disc 50 being driven by the hour shaft 31 to rotate simultaneously, as shown in FIGS. 7 and 8, a securing means 56 is used to affix the time zone disc 50 to the engaging head 311 of the hour shaft 31. The securing means 56 comprises three axial driving ribs 561 spacedly protruded on an outer periphery surface of the engaging head 311 of the hour shaft 31 and extended along an axis of the hour shaft 31. The periphery of the center hole 51 of the time zone disc 50 also provides three indents 511 adapted to match and engage with the three driving fibs 561 respectively.

Figure 9A:
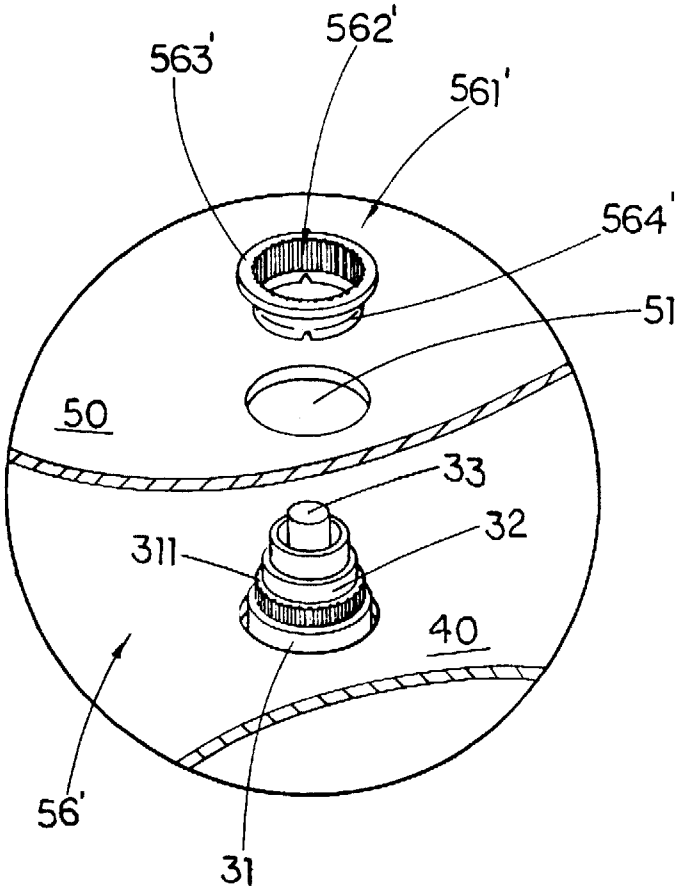
FIG. 9 is a partial exploded view of an alternative mode of the universal time equipment of the present invention.
Figure 9B:
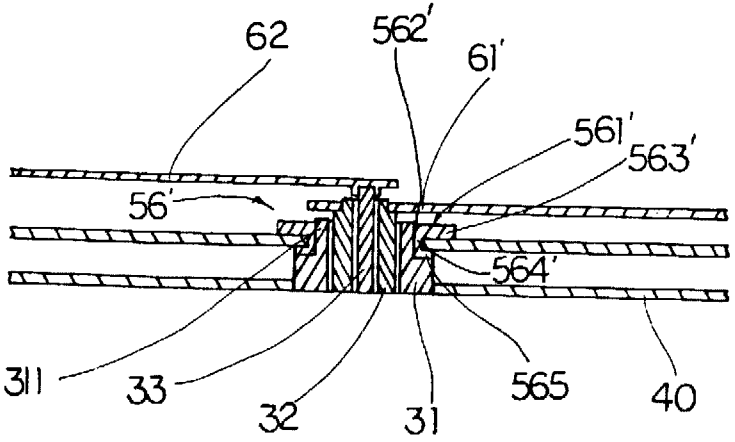

When a very thin transparent plastic material is used to make the time zone disc 50, an alternative mode of a securing means 56' as illustrated in FIGS. 9A and 9B is preferred to use for ensuring the engagement of the center hole 51 of the time zone disc 50 and the engaging head 311 of the hour shaft 31. The alternative form of the securing means 56' comprises a metal or plastic securing ring 561' which has a central engaging hole 562', a top rim 563, and a ring body 564' coaxially extending from the top rim 563'. The ring body 564' has an outer diameter slightly smaller than the center hole 51 of the time zone disc 50, an inner diameter equal to or slightly smaller than the outer diameter of the engaging head 311 of the hour shaft 31, and a height longer than the thickness of the time zone disc 50. To assemble, penetrate the ring body 563' of the securing ring 561' through the center hole 51 of the time zone disc 50 and then press and bend a bottom end 565' of the ring body 563' outwardly to press against the bottom surface of the time zone disc 50 so as to firmly affixed the securing ring 561' to the time zone disc 50. Therefore, the time zone disc 50 is capable of securing to the hour shaft 31 by forcing the engaging head 311 of the hour shaft 31 to insert through the engaging hole 562' of the securing ring 561'. For better engagement, the inner surface of the ring body 564' and the outer surface of the engaging head 311 are coarse surfaces to increase the friction therebetween.

As shown in FIG. 4, as mentioned above, the user of the time equipment does not feel the self-rotation of the earth. In fact, human being on earth can only feel the sun rotating around the earth for one revolution per 24 hours, so that we observe dawn in the east in the early morning and sunset in the west before evening. It is an important feature of the present invention that the present of the sun mark 54 which is aligned with the local time zone city 521 of the user, e.g. Hong Kong, and rotates around the earth like dial 40 in the present invention exactly likes the natural sun as the user observed in Hong Kong rotating around the earth. Moreover, since the time zone disc 50 of the present invention is driven to rotate one revolution per 24 hours also, all the 24 time zone indicators 521 just like the actual 24 time zones on earth being rotated one revolution per day. In other words, the user can ascertain the position of the sun and the "time condition" of a day anytime and anywhere simply by viewing the time equipment of the present invention.

Figure 10:
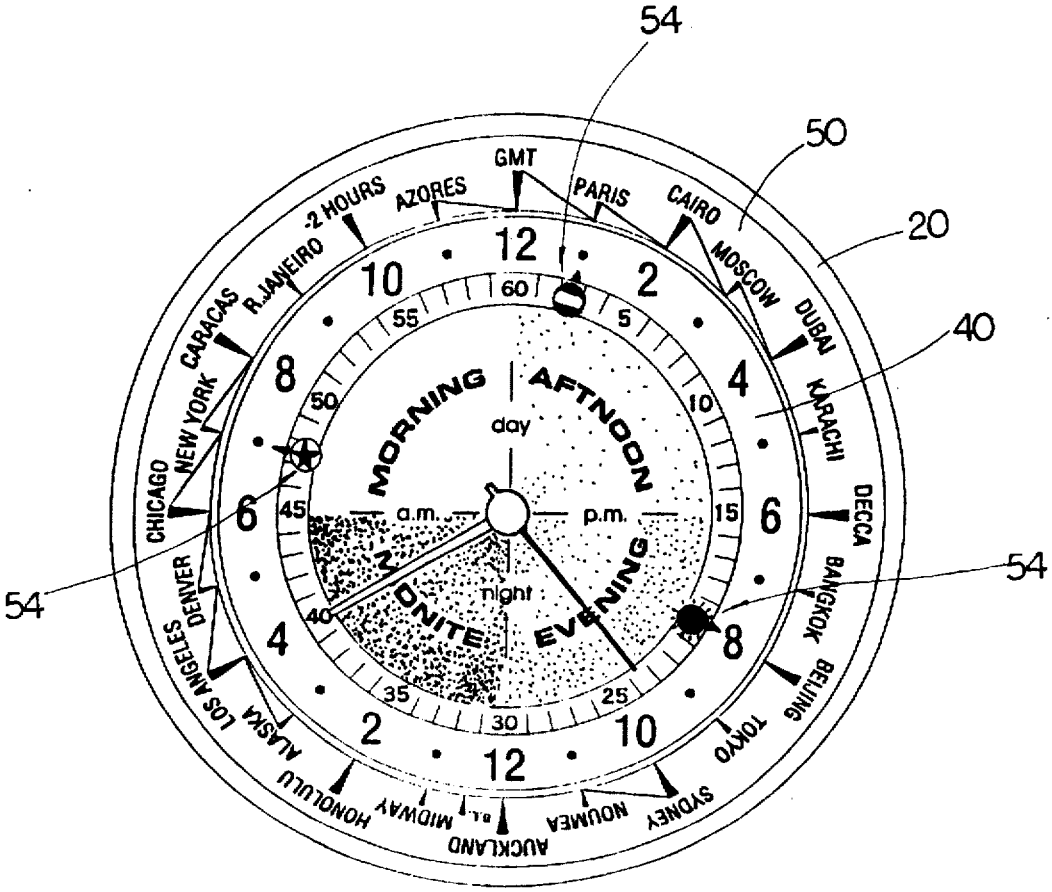
FIG. 10 is a front view of the present invention in which more than one sun marks are utilized.

As shown in FIG. 10, it should be understood that more than one sun mark 54 can be provided on the time zone disc 50 to selectively align with the corresponding time zone indicators 521 so as to facilitate the user to observe the times of those cities he or she traveling or communicating the most, in which these sun marks 54 can be printed with different colors or printed as the national flag diagrams of those aligning time zone cities respectively.

The universal time equipment of the present invention substantially is a breakthrough of the timepiece history. The following specific features can be achieved through the present invention.

1. The universal time equipment of the present invention not only can simultaneously provide dear indication of the current times of the 24 time zones around the world, but also can dearly indicate the "time condition" in a day for the observed current time of any time zone.

2. It indicates the time in each time zone without the present of the hour hand.

3. It is able to drive the time zone disc to complete one revolution every 24 hours (just like the self-rotation of the earth everyday) without incorporating with any additional driving mechanism. Therefore, the present invention minimizes its constructive parts and is easy to assemble in inexpensive cost.

4. It enables the user to read the hour, minute and second of the time in each time zone (city) around the world easily, in which the 24 hour pointers are radically extended from the 24 time zone indicators to the inner periphery of the time zone ring portion respectively for aligning with the 24 hour scales of the hour indicating ring portion respectively. Besides, the minute indicating ring portion is adjacent to the inner periphery of the hour indicating ring portion, so that the user can simply and effectively read the time of any particular time zone city as indicated in the time zone disc by simply and effectively observing the particular time zone city on the time zone disc and reading the hour scale adjacent the corresponding hour pointer and, at the same time, reading the exact minute and second of time off the minute and second hands that sweeps the adjacent minute indicating ring portion.

5. It incorporates with at least a sun mark to particularly distinct the local time from the times of other time zones.

I claim:

1. An universal time equipment, comprising a 24-hour movement, which is installed in a case, coupling and driving at least an hour shaft to rotate one revolution per 24 hours and a minute shaft to rotate one revolution per one hour;

a stationary dial mounted above said movement in said case, in which a front surface of said dial provides an outer hour indicating ring portion, an inner minute indicating ring portion arranged radically adjacent an inner periphery of said outer hour indicating ring portion, and a circular central time condition indicating portion encircled by said inner minute indicating ring portion, said time condition indicating portion which is positioned on a central circular portion of said dial having a central cross inscription and a central hole for permitting said hour and minute shafts to pass through, said central cross inscription having a vertical line extending from a top position to a bottom position of said time condition indicating portion and a horizontal line extending from a left position to a right position of said time condition indicating portion, so as to divide said time condition indicating portion into a top-left quarter section, a top-right quarter section, a bottom-right quarter section, and a bottom-left quarter section, a day indicator and a night indicator being provided on said upper and lower portions of said time condition indicating portion respectively, a antemeridian indicator and a postmeridian indicator being provided on said left and said right portions of said time condition indicating portion respectively, a rooming indicator, an afternoon indicator, an evening indicator, and a midnight indicator being provided on said top-left, top-right, bottom-right, and bottom-left quarter sections respectively, said minute indicating ring portion being evenly divided into 60 annular scales providing a visual indication of 60 minutes in one hour, said hour indicating ring portion peripherally encircling said minute indicating ring portion provides 24 hour scales inscribed thereon, which are two sequences of numerals ordered by increasing value from 1 to 12 and arranged circularly spaced apart angularly, wherein a first numeral "12" is provided in a top position of said hour indicating ring portion, a second numeral "12" is provided in a bottom position of said hour indicating ring portion, a first numeral "6" is provided in a left position of said hour indicating ring portion, and a second numeral "6" is provided in a right position of said hour indicating ring portion;

a transparent rotatable time zone disc having a center hole for securing to said hour shaft for being driven by said hour shaft to rotate above said dial underneath to complete one revolution per 24 hours, said time zone disc further having a time zone ring portion provided on an outer periphery thereof to encircle a transparent central portion which has a diameter at least equal to an outer diameter of said hour indicating ring portion of said dial for revealing said hour indicating ring portion, said minute indicating ring portion and said time condition indicating portion of said dial underneath, said time zone ring portion providing 24 time zone indicators arranged circularly spaced apart angularly to represent 24 time zone cities, 24 hour pointers being radically extended from said 24 time zone indicators to an inner periphery of said time zone ring portion respectively to align with said 24 hour scales of said hour indicating ring portion respectively, said time zone disc further providing at least a sun mark thereon, said sun mark being positioned in a predetermined position adjacent to said inner periphery of said hour indicating ring portion of said dial and radically aligned with one of said time zone indicators, so as to enable said hour scales being revealed between said sun mark and said time zone indicator aligned with said sun mark; and a minute hand securing to said minute shaft for being driven to rotate above said time zone disc to complete one revolution per one hour.

2. An universal time equipment, as recited in claim 1, in which said four quarter sections have more than one different colors, wherein said bottom-right and bottom-left quarter sections have a darker color than the color of said top-left and top-right quarter sections for visually distinguishing said top-left and top-right quarter sections from said bottom-right and bottom-left quarter sections.

3. An universal time equipment, as recited in claim 2, in which a predetermined number of said time zone indicators, which represent a plurality of time zone cities utilizing summer time, further provide a plurality of projection lines respectively, each of said projection lines being positioned between two of said hour pointers, wherein each projection line being extended closewise from an outer end of said hour pointer of said corresponding time zone indicator which utilizes summer time to an inner end of another said hour pointer adjacent thereto.

4. An universal time equipment, as recited in claim 3, said 24 time zone indicators are 24 inscriptions of 24 time zone city names.

5. An universal time equipment, as recited in claim 1, in which said sun mark further provides a sun mark pointer radically extending therefrom and pointing to said aligning time zone indicator.

6. An universal time equipment, as recited in claim 4, in which said sun mark further provides a sun mark pointer radically extending therefrom and pointing to said aligning time zone indicator.

7. An universal time equipment, as recited in claim 1, in which said day indicator is a "day" mark inscribed on an upper part of said vertical line, said night indicator being a "night" mark inscribed on a lower part of said vertical line, said antemeridian being an "a.m." mark inscribed on a left part of said horizontal line, said postmeridian being a "p.m." mark inscribed on a right part of said horizontal line, said morning indicator is a "MORNING" mark inscribed on a predetermined position of said top-left quarter section in an arc form extending from said left part of said horizontal line to said upper past of said vertical line, said afternoon indicator being an "AFTNOON" mark inscribed on a predetermined position of said top-right quarter section in an arc form extending from said upper part of said vertical line to said right part of said horizontal line, said evening indicator is a "EVENING" mark inscribed on a predetermined position of said bottom-right quarter section in an arc form extending from said right part of said horizontal line to said lower part of said vertical line, said midnight indicator being a "MIDNITE" mark inscribed on a predetermined position of said bottom-left quarter section in an arc form extending from said lower part of said vertical line to said left part of said horizontal line.

8. An universal time equipment, as recited in claim 6, in which said day indicator is a "day" mark inscribed on an upper part of said vertical line, said night indicator being a "night" mark inscribed on a lower part of said vertical line, said antemeridian being an "a.m." mark inscribed on a left part of said horizontal line, said postmeridian being a "p.m." mark inscribed on a right part of said horizontal line, said morning indicator is a "MORNING" mark inscribed on a predetermined position of said top-left quarter section in an arc form extending from said left part of said horizontal line to said upper part of said vertical line, said afternoon indicator being an "AFTNOON" mark inscribed on a predetermined position of said top-right quarter section in an arc form extending from said upper part of said vertical line to said right part of said horizontal line, said evening indicator is a "EVENING" mark inscribed on a predetermined position of said bottom-right quarter section in an arc form extending from said right part of said horizontal line to said lower part of said vertical line, said midnight indicator being a "MIDNITE" mark inscribed on a predetermined position of said bottom-left quarter section in an arc form extending from said lower part of said vertical line to said left part of said horizontal line.

9. An universal time equipment, as recited in claim 1, in which a top portion of said hour shaft reduces an outer diameter thereof to form an engaging head which has a height at least equal to a thickness of said time zone disc and an outer diameter at least equal to a diameter of said center hole of said time zone disc, so that said time zone disc is firmly secured to said hour shaft by inserting said engaging head of said hour shaft through said center hole of said time zone disc.

10. An universal time equipment, as recited in claim 9, in which a securing means is used to affix said time zone disc to said engaging head of said hour shaft so as to ensure said time zone disc being driven by said hour shaft to rotate simultaneously.

11. An universal time equipment, as recited in claim 10, in which said securing means comprises at least an axial driving rib protruded on an outer periphery surface of said engaging head of said hour shaft and extended along an axis of said hour shaft, and that a periphery of said center hole of said time zone disc also provides at least an indent to match and engage with said driving rib.

12. An universal time equipment, as recited in claim 10, in which said securing means comprises a securing ring which has a central engaging hole, a top rim, and a ring body coaxially extending from said top rim, said ring body having an outer diameter slightly smaller than said center hole of said time zone disc, an inner diameter at least equal to said outer diameter of said engaging head of said hour shaft, and a height longer than said thickness of said time zone disc, wherein said ring body of said securing ring is penetrated through said center hole of said time zone disc, a bottom end of said ring body being pressed and bent outwardly to press against a bottom surface of said time zone disc so as to firmly affix said securing ring to said time zone disc, so that said time zone disc is secured to said hour shaft by forcing said engaging head of said hour shaft to insert through said engaging hole of said securing ring.

13. An universal time equipment, as recited in claim 12, in which said inner surface of said ring body and said outer surface of said engaging head are coarse surfaces to increase the friction therebetween.

14. An universal time equipment, as recited in claim 8, in which a top portion of said hour shaft reduces an outer diameter thereof to form an engaging head which has a height at least equal to a thickness of said time zone disc and an outer diameter at least equal to a diameter of said center hole of said time zone disc, so that said time zone disc is firmly secured to said hour shaft by inserting said engaging head of said hour shaft through said center hole of said time zone disc.

15. An universal time equipment, as recited in claim 14, in which a securing means is used to affix said time zone disc to said engaging head of said hour shaft so as to ensure said time zone disc being driven by said hour shaft to rotate simultaneously.

16. An universal time equipment, as recited in claim 15, in which said securing means comprises at least an axial driving rib protruded on an outer periphery surface of said engaging head of said hour shaft and extended along an axis of said hour shaft, and that a periphery of said center hole of said time zone disc also provides at least an indent to match and engage with said driving rib.

17. An universal time equipment, as recited in claim 15, in which said securing means comprises a securing ring which has a central engaging hole, a top rim, and a ring body coaxially extending from said top rim, said ring body having an outer diameter slightly smaller than said center hole of said time zone disc, an inner diameter at least equal to said outer diameter of said engaging head of said hour shaft, and a height longer than said thickness of said time zone disc, wherein said ring body of said securing ring is penetrated through said center hole of said time zone disc, a bottom end of said ring body being pressed and bent outwardly to press against a bottom surface of said time zone disc so as to firmly affix said securing ring to said time zone disc, so that said time zone disc is secured to said hour shaft by forcing said engaging head of said hour shaft to insert through said engaging hole of said securing ring.

18. An universal time equipment, as recited in claim 1 in which said inner surface of said ring body and said outer surface of said engaging head are coarse surfaces to increase the friction therebetween.

* * * * *